United States Patent [19]

Chow

[11] Patent Number: 4,922,262

[45] Date of Patent: May 1, 1990

[54] LOG-PERIODIC SLOT ANTENNAS

[75] Inventor: Yung L. Chow, Waterloo, Canada

[73] Assignee: Her Majesty the Queen in right of Canada, as represented by the Minister of National Defence, Ottawa, Canada

[21] Appl. No.: 296,565

[22] Filed: Jan. 13, 1989

[30] Foreign Application Priority Data

Jan. 18, 1988 [CA] Canada ..... 556718

[51] Int. Cl.[5] ..... H01Q 11/10

[52] U.S. Cl. ..... 343/770; 343/792.5

[58] Field of Search ..... 343/792.5, 770

[56] References Cited

U.S. PATENT DOCUMENTS

| | | | |
|---|---|---|---|
| 3,369,243 | 2/1968 | Greiser | 343/770 |
| 3,633,207 | 1/1972 | Ingerson et al. | 343/700 |
| 3,696,438 | 10/1972 | Ingerson | 343/792.5 |
| 4,594,595 | 6/1986 | Struckman | 343/792.5 |

OTHER PUBLICATIONS

Ingerson et al., "Log-Periodic Antennas with Modulated Impedance Feeders", IEEE Trans. on Antennas and Prop., vol. AP-16, No. 6, Nov. 1968, pp. 633-642.

"Millimeter Wave Engineering and Applications" by P. Bhartia and I. J. Bahl, A Wiley-Interscience Publication, 1984.

*Primary Examiner*—Rolf Hille
*Assistant Examiner*—Michael C. Wimer
*Attorney, Agent, or Firm*—Michael Zelenka; Ann M. Knab

[57] ABSTRACT

A log-periodic slot antenna has adjacent radiating elements connected by off-center co-planar lines thereby providing the required phase reversal and modifying the element impedance to match that of the co-planar line. By providing a ground plane restricted in size to that of the element array a difference pattern can be formed by the single antenna giving a sharp null in the longitudinal direction of the antenna. A dual log-periodic antenna formed from two such single antennas can be fed in-phase and produce two difference patterns one in the co-planar plane and one in the cross-polar plane.

11 Claims, 8 Drawing Sheets

LOG-PERIODIC SLOT ANTENNAS

TECHNICAL FIELD

The present invention relates to log-periodic slot antennas and, in particular, to the construction of such antennas having a sharp null in the antenna pattern. The invention also relates to a dual log-periodic slot antenna of a configuration so as to have difference pattern nulls both in the co-polarization and cross-polarization planes.

BACKGROUND OF THE INVENTION

Log-periodic antennas have radiating elements arranged such that the dimensions both of the radiating elements and the spacing between them increase logarithmically from one end of the array to the other so that the ratio of element length to element spacing remains constant. Such antennas maintain a relatively constant radiation pattern over a large frequency range.

Although dipole arrays are frequently employed, it is possible to construct log-periodic antennas with slots as the radiating elements, as shown in U.S. Pat. Nos. 3,369,243 to Greiser and 3,633,207 to Ingerson, issued Feb. 13, 1968 and Jan. 4, 1972, respectively. The slot antenna is the dual of the dipole antenna having the same radiation pattern but with the polarization rotated by 90° . The relationship between the radiation impedance $Z_s$ of the slot antenna and the radiation impedance $Z_d$ of the dipole antenna is:

$$Z_5 = \frac{(377)^2}{42d}\ \Omega$$

Two difficulties encountered in the design of logberiodic slot antennas are the impedance of the connection between the radiating elements and the requirement to provide phase reversal of the feed between adjacent elements. A simple dipole at resonance has an impedance of 73Ω. The log-periodic dipole antenna is a series of these dipoles connected by twin-lead lines. The twin-lead line has a slightly larger impedance, about 100Ω. A simple slot at resonance has an impedance of 487Ω which requires a "twin-slot", (co-planar guide) of 355Ω. A co-planar line of such impedance requires a very small, center conductor and is not practical. The required phase reversal between adjacent dipoles of a log-periodic dipole antenna is accomplished by twisting the interconnecting twin-lead between them, or by an equivalent arrangement. The same cannot be done for the log-periodic slot antenna, however, because it is topologically impossible to twist slots etched on a ground plane.

SUMMARY OF THE INVENTION

The two difficulties are overcome in accordance with the present invention by feeding the slot elements of the log-periodic slot at the quarter point /4. The novel structure of the invention overcomes the two difficulties by:

(i) reducing the input impedance at resonance of a simple slot. When the feed point is moved to, say, /4 from /2, the center, the impedance is 243Ω, half of the original impedance of a center feed. This means that the twin slot needs a co-planar line impedance of 178Ω which is easily achieved; and (ii) alternately locating the feed point at, /4 and 3 /4 so that the phase reversal between adjacent slot elements is accomplished without attempting to twist the "twin slot" co-planar guide.

Specifically, this aspect of the invention relates to a log-periodic slot antenna comprising an array of log-periodically spaced, parallel radiating slots of increasing length, and a plurality of coplanar guides each line connecting one pair of adjacent slots. The coplanar guides are arranged alternately on opposite sides of the center line of the antenna, the connection point with each slot being spaced from the adjacent slot edge by a distance approximately one quarter of the slot length.

If the ground plane can be assumed to be of infinite extent the radiation pattern of the log-periodic slot antenna is the same as that of the log-periodic dipole antenna. The radiation impedance is about 170 to 200Ω, similar to the log-periodic dipole antenna. The slot version maintains approximately the same radiation pattern and impedance throughout its designed frequency range. The polarization of the radiation, is not parallel to the slots but is perpendicular to the slots.

The invention also contemplates the modification of the antenna so far described to have ground plane of the same order of magnitude as the dimensions of the slot array. This produces a sharp null in the forward direction which is useful for accurate direction finding. The radiation pattern of the single antenna is termed a difference pattern by analogy with the conventional difference pattern formed between the main beams of two antennas fed in opposite phase. In the case of the log-periodic slot antenna the E vectors set up at both sides of the slot antenna become opposite to each other at the edge of the ground plane. This is equivalent to two antennas in opposite phase and gives a difference pattern along the direction of the edge. This result of null formed by an edge exists for all slot antennas. In the case of the log-periodic slot antenna, the null is more pronounced in the forward direction of the antenna, and the difference pattern remains nearly the same over a wide band of frequencies.

As noted, the conventional broadband difference pattern is formed by feeding two identical broadband antennas in opposite phases. The opposite phase feed is in fact a balanced load and a broadband balun is frequently needed to match the balanced load to a coaxial line. The unbalanced coaxial line is the common type of transmission line from a microwave source. The broadband balun is difficult to make, especially for a broadband ratio of 3 to 1 and beyond and for high frequencies of 3 GHz and beyond. In contrast, the present invention forms the broadband difference antenna pattern by having a log-periodic slot antenna with finite ground plane. The ground plane is preferably small to achieve two wide beams beside the central null. The finite ground plane can be of arbitrary shape without affecting the direction of the null.

Thus, this aspect of the invention relates to a log-periodic slot antenna comprising a ground plane conductor having an array of spaced, parallel radiating slots of increasing length, and a plurality of coplanar guides, each line connecting one pair of adjacent slots. The coplanar lines are arranged alternately on opposite sides of the center line of the antenna, the connection point with each slot being spaced from the adjacent slot edge by a distance approximately one quarter of the slot length. The dimension of the ground plane is of the same order of magnitude as the dimensions of the array whereby the antenna pattern has a null in the forward direction in the plane of the ground plane.

The invention includes a further modification using two such log-periodic slot antennas fed in phase. The single log-periodic slot antenna discussed above has the desired difference antenna pattern in the co-polarization (i.e., perpendicular to the ground plane) plane. As is described later in this application it also has a sum antenna pattern for the cross-polarization. This is desirable for accessing of the radiating source with the sum pattern and then determine accurately its bearing by the difference pattern. For some applications it may be desirable to replace the sum pattern by a difference pattern, so that there are difference patterns in both the co-polarized plane for co-polarization and in the cross-polarized plane for cross-polarization.

It is known to form a difference pattern by having two identical antennas fed in the opposite phase. This requires a balun and for broadband applications, a broadband balun. As previously stated a broadband balun is difficult to construct especially for a broadband ratio of 3 to 1, and for frequencies above 3 GHz.

The present invention forms the difference pattern not by feeding the two log-periodic slot antennas in opposite phase, but by feeding the two antennas in phase. Two difference patterns are obtained The edges of the ground plane are cut to maintain the general frequency independent shape of the log-periodic antenna.

Specifically, the invention relates to a direction finding antenna comprising a pair of log-periodic slot antennas as previously described, the antennas being arranged with a common vertex and with their ground planes coplanar, an in-phase feed connection for each antenna whereby the cross-polarization antenna pattern in the plane of the antenna has a null in the forward direction.

BRIEF DESCRIPTION OF THE DRAWINGS

Preferred embodiments of the invention will now be described in conjunction with the accompanying drawings in which.

DETAILED DESCRIPTION

Figure 1:
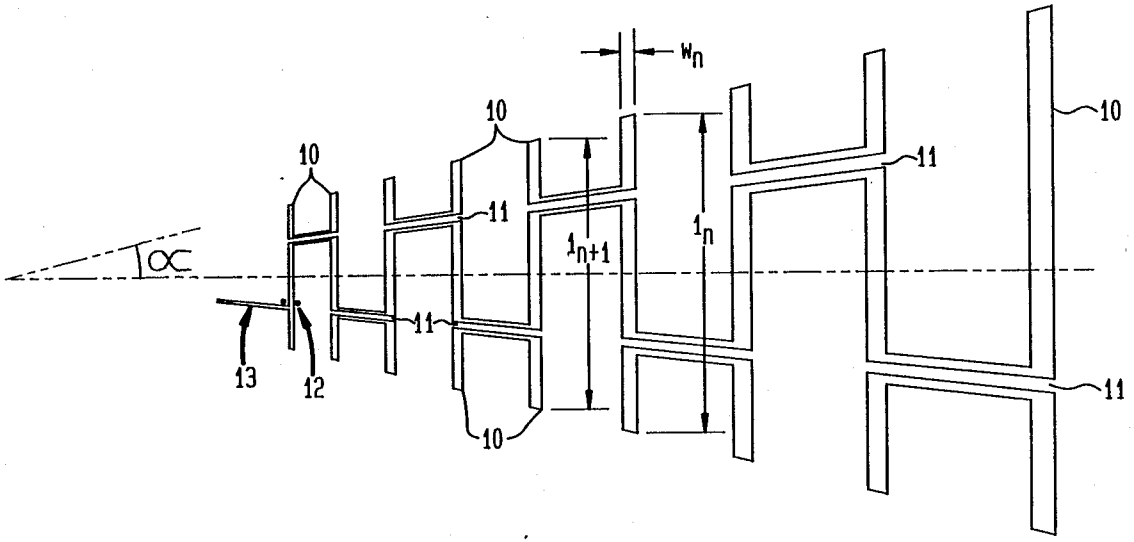
FIG. 1 is a schematic view of a log-periodic slot antenna in accordance with the present invention.

FIG. 1 shows the basic log-periodic slot antenna constructed in accordance with the present invention. An array of spaced, parallel, radiating slots 10 constitute the radiating elements and these slots are linked by coplanar guides 11. Rather than being attached to the center of each slot the coplanar guides extend from a point L/4 from the end of each slot where L is the slot length. The connection point of the coplanar guides alternates on either side of the axis or longitudinal direction of the antenna to provide the necessary phase reversal between adjacent elements. The antenna feed itself is supplied at connection 12 which is also L/4 away from the nearer end of the slot but on the opposite side of the antenna from the coplanar guide attached to that slot. 13 is an elongate narrow slot to perform the function of a low frequency block.

A particular slot antenna has the following ratios:

$$\frac{x_n}{x_{n-1}} = \frac{L_n}{L_{n-1}} = 0.84$$

$$\frac{d_n}{2L_n} = 0.16$$

$$L_n/w_n = 15$$

$$\alpha = 14.3^\circ$$

where $x_n$ is the distance of a slot from the vertex to the antenna, $\alpha$ is the antenna angle at the vertex, L is the slot length, d is the distance between slots and w is the slot width.

In a typical antenna there are 9 slots, the longest being 16.8 cm, the shortest being 4.2 cm. The frequency range is nominally from 0.85 to 3.4 GHz. The coplanar guide connecting two slots has a characteristic impedance of 178Ω.

The invention so far described requires an infinite ground plane in order to be a log-periodic dipole antenna. Clearly, the provision of a large ground plane is not always practicable and it has further been found that the provision of a smaller ground plane having a size only of the same order magnitude as that of the array of slots provides useful properties.

Figure 2:
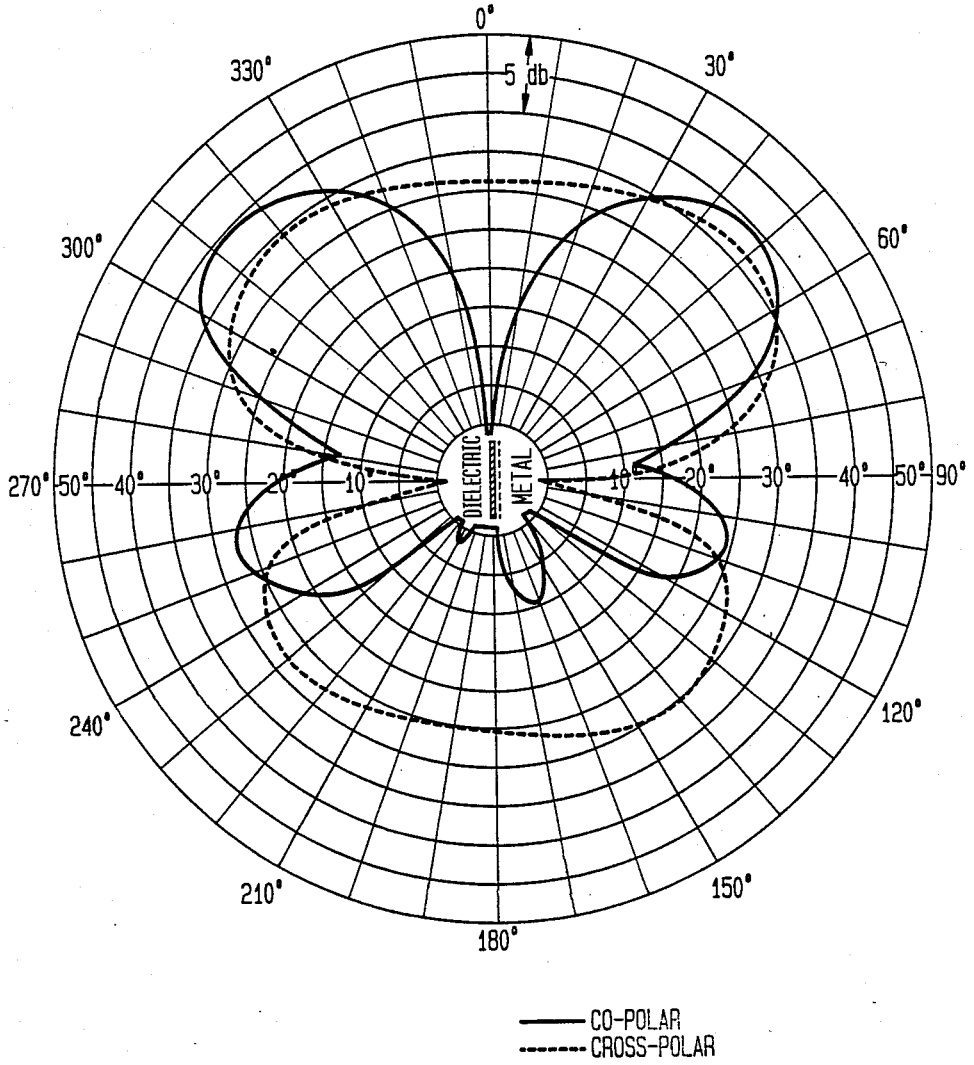
FIG. 2 is the antenna pattern produced by an antenna of the form of FIG. 1 when operated with a smaller ground plane.

When the ground plane is reduced to being a rectangle of appropriate size just to contain the array of slots then the antenna pattern changes to that shown in full lines in FIG. 2. Of particular interest in this particular pattern is the null which occurs in the forward direction in the plane of the ground plane. The shape of the ground plane is not at all critical and it can be of any arbitrary shape without affecting the direction of the null. The null of this antenna is much narrower than the single main beam of a regular antenna (i.e., sum) pattern, because it is a difference pattern. This can be used for accurate direction finding of a radiating source.

Figure 3:
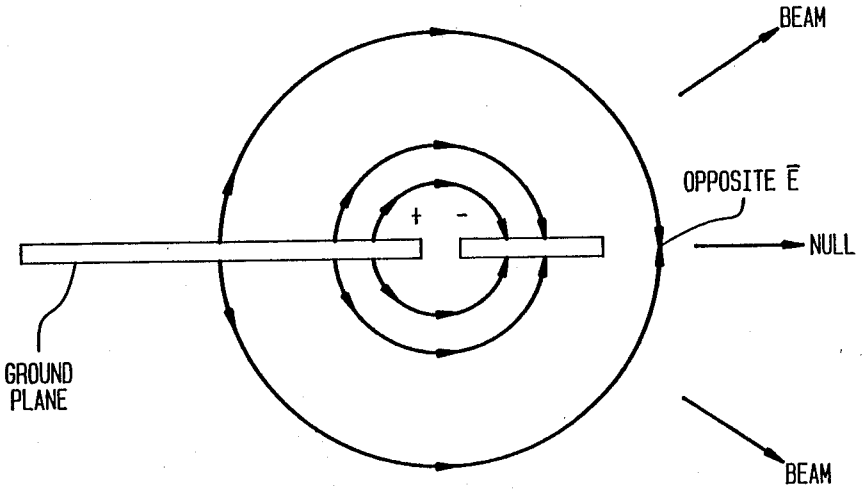
FIG. 3 is a schematic view showing the directions of the E fields causing the difference antenna pattern of FIG. 2.

As shown in FIG. 3, the null is formed by the E vectors set up at both sides of the slot which antenna which become opposite to each other at the edge of the ground plane. This is equivalent to two antennas in opposite phase and gives a difference pattern along the direction of the edge. This result of null formed by an edge exists for all slot antennas. In the case of the log-periodic slot antenna, the null is more pronounced in the forward direction of the antenna, and the difference pattern remains nearly the same over a wide band of frequencies. The cross-polarization pattern, on the other hand, is a regular "sum" pattern with a main beam instead of a null in the boresight direction shown by the dotted line in FIG. 2. This antenna is thus unique in having both the sum and difference patterns in the two polarizations. Since one antenna of this type can have the sum and difference patterns in two polarizations, this antenna can be conveniently used to access the radiating source with the sum pattern of the cross-polarization and then accurately locate the bearing of the source by the difference pattern of the cross-polarization.

It is useful to define the polarizations and radiation patterns produced by this antenna. The normal E vector of a slot antenna is perpendicular to the ground plane. This may be called the co-polarization and, as described, has a difference pattern due to the edge of a finite ground plane. The difference pattern is called the co-polar plane pattern. It is not called the E plane pattern because the log-periodic slot antenna with a small ground plane can also receive and transmit a signal with the E vector parallel to the ground plane. This is explained below.

Slot 13 with the feed connection may be viewed as a "thick loop" antenna around the log-periodic slots. The thick loop antenna has a complicated shape and cannot easily be analyzed but it is expected to be wide band. The radiation pattern of the thick loop antenna is a "sum pattern" with a main beam (i.e., as opposed to a difference pattern with a null in the original main beam direction). The polarization is parallel to the ground plane and is called the cross-polarization. The pattern on this plane may be called the cross-polar-plane pattern.

The radiation patterns in the co-polar and cross-polar planes with both cross and co-polarizations of the transmitter, for various frequencies are shown in FIG. 2.

The radiation patterns at different polarizations are summarized as follows:

(a) co-polar plane patterns
  (i) co-polarization - difference pattern
  (ii) cross-polarization - sum pattern
(b) cross-polar plane patterns
  (i) co-polarization - null pattern
  (ii) cross-polarization - sum pattern That is, the log-periodic slot antenna with a small ground plane has one difference pattern and two sum patterns.

Figure 4:
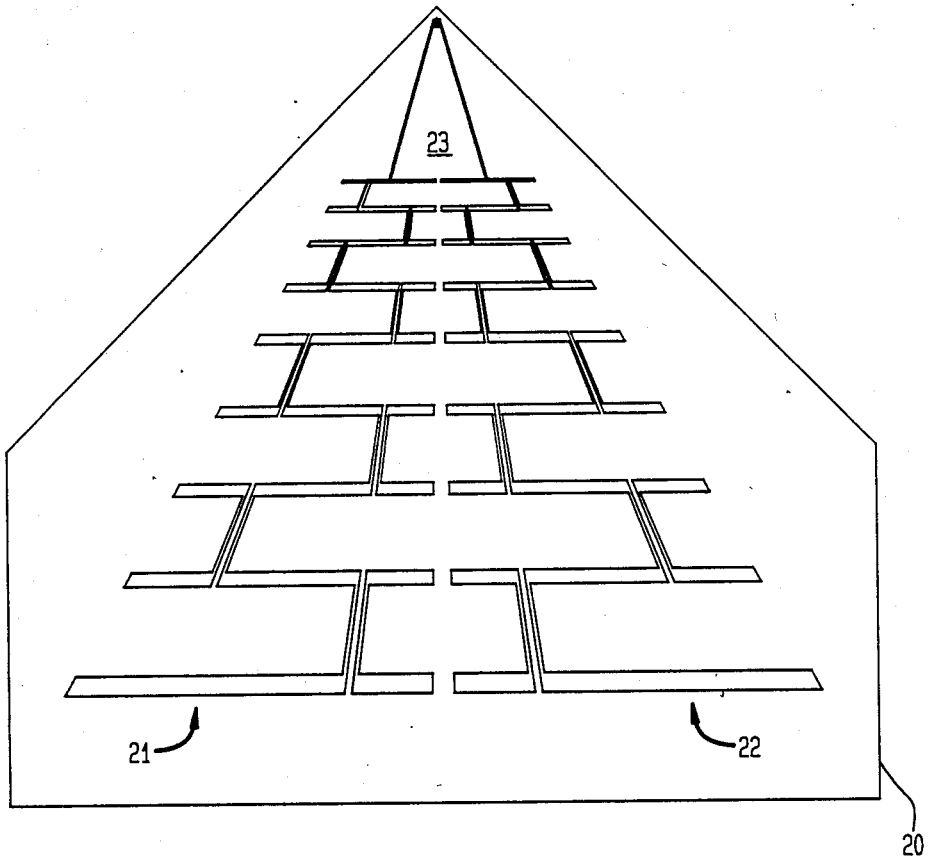
FIG. 4 is a schematic view of a dual log-periodic slot antenna in accordance with the present invention.
Figure 5:
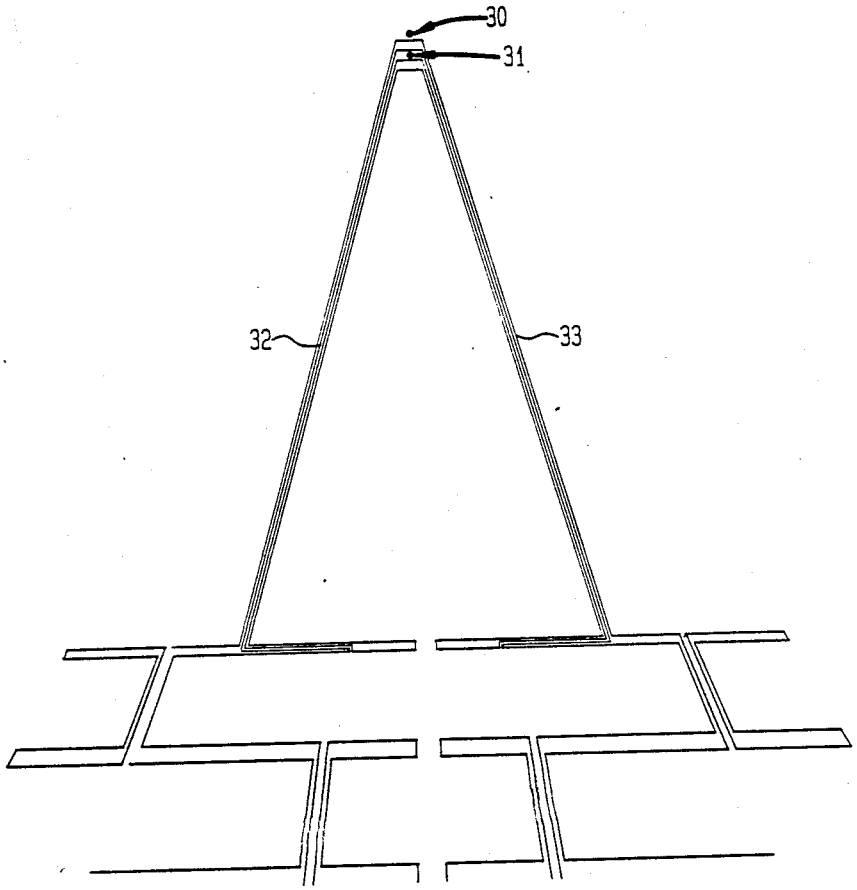
FIG. 5 is a schematic view of the in-phase feed connection for the antenna of FIG. 4.

FIG. 4 shows an embodiment using two log-periodic slot antennas fed in phase. The ground plane 20 contains two log-periodic slot arrays 21 and 22 having an in phase feed structure 23. FIG. 5 shows more details of the feed applied at terminals 30 and 31 and coupled to each antenna by co-planar guides 32 and 33. The co-planar guides connected to the two log-periodic slot antenna in FIGS. 4 and 5 are 200Ω lines. The radiation impedances measured at different frequencies ascertained that the match to 50Ω line at the feed point is quite good.

Figure 6:
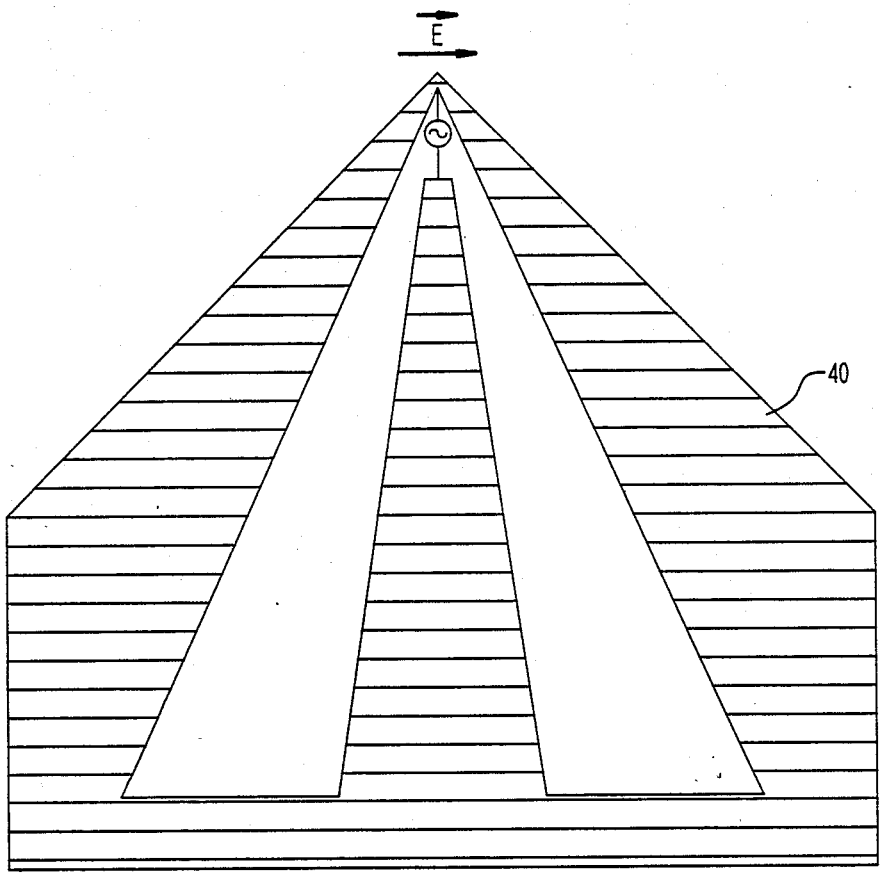
FIG. 6 shows the electrical equivalent of the antenna of FIG. 4 for the cross-polarization feed.

While the two log-periodic slot antennas are fed in phase for the co-polarization (i.e., E field perpendicular to the ground plane), they are effectively fed out of phase for the cross-polarization. In the cross-polarization, the dual log-periodic slot antenna is not what it is, but is a V-shaped slot antennas forming a shape as shown in FIG. 6 where 40 represents the metallized area. The dissymmetry in the off boresight direction gives the difference pattern. The symmetry at the boresight direction gives a null.

Figure 7:
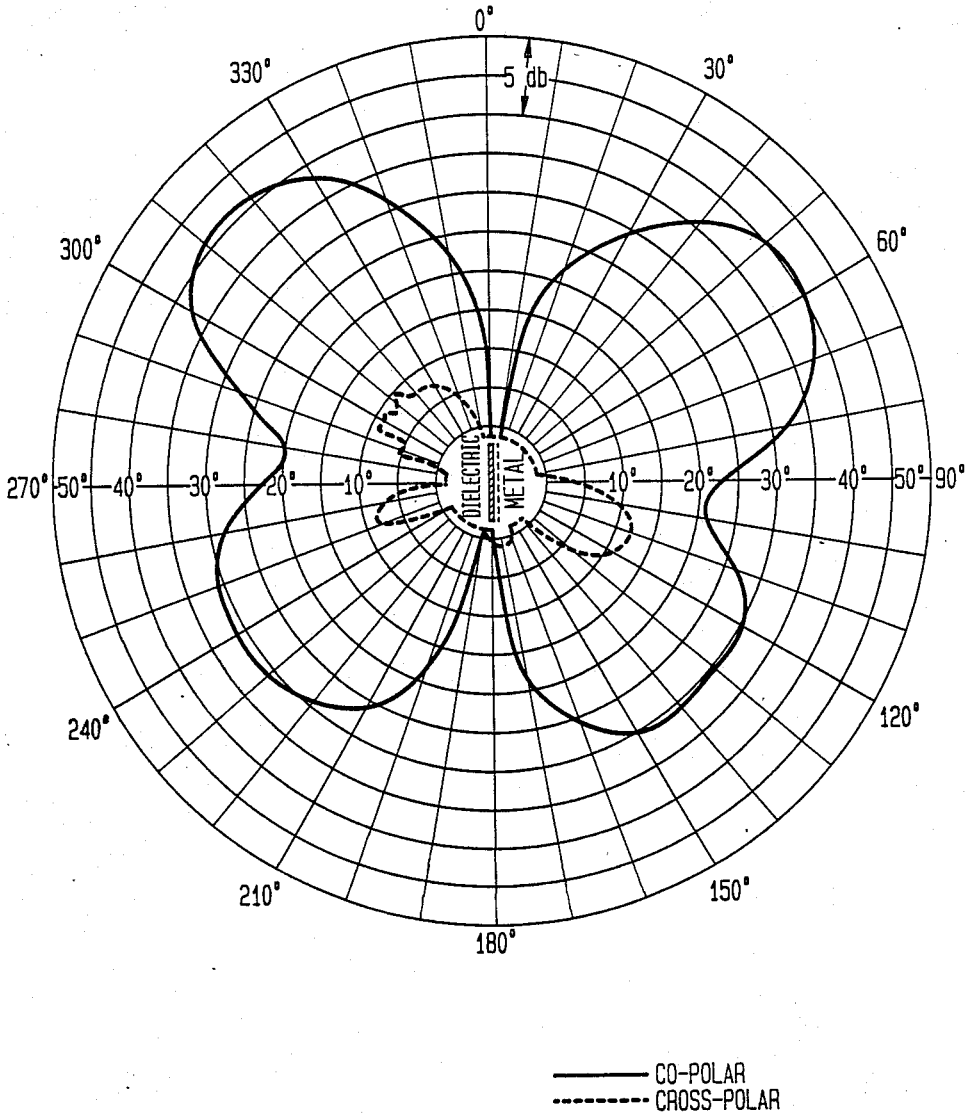
FIGS. 7 and 8 show the radiation patterns for the antenna of FIG. 4 on the co-polar and cross-polar planes, respectively.
Figure 8:
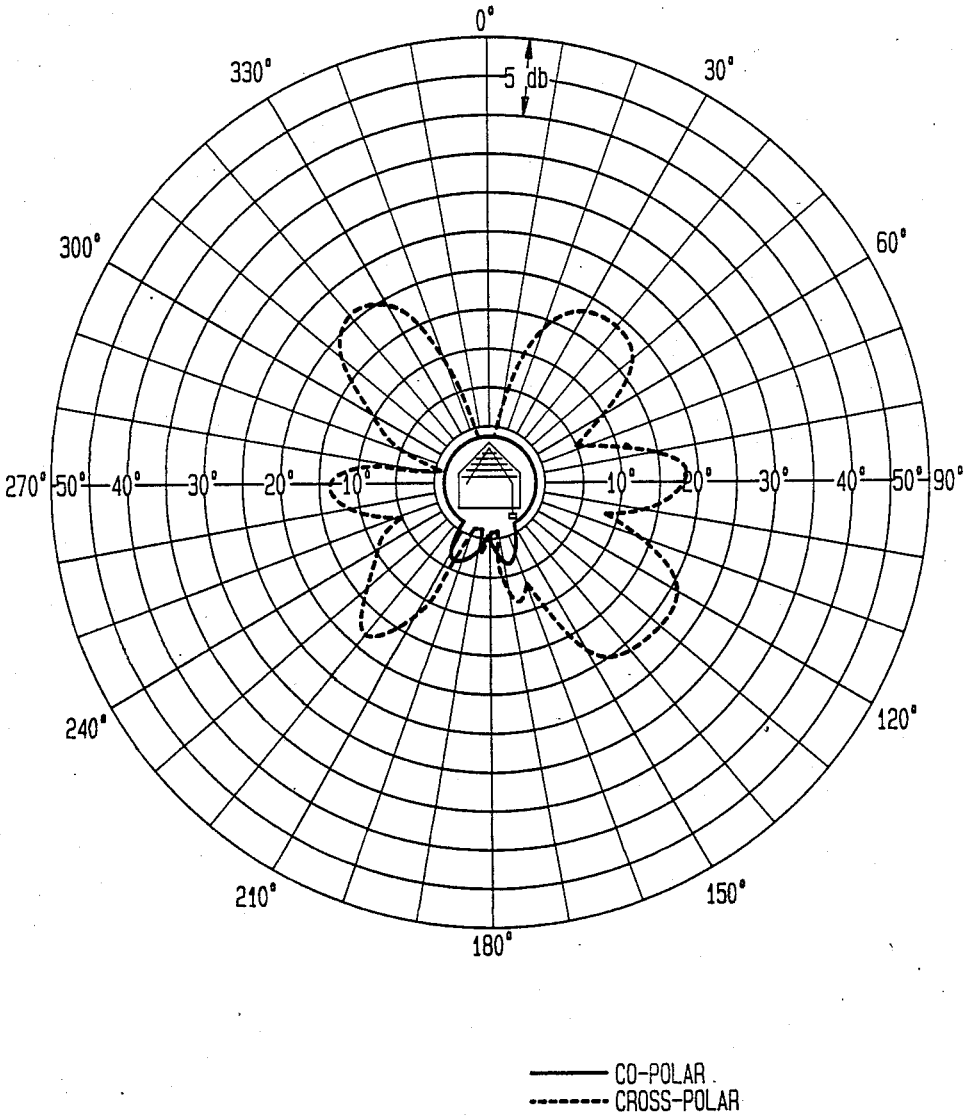

The measured radiation patterns in the co-polar and cross-polar planes with co-polarizations and cross-polarizations from the transmitter are given in FIGS. 7 and 8, which show a difference pattern in the co-polar plane for the co-polarization and a difference pattern in the cross-polar plane for the cross-polarization.

As a comparison to the list of sum and difference patterns of the single log-periodic slot antenna with a small ground plane, previously set out, the following is the list of patterns for the dual log-periodic slot antenna.

(a) co-polar plane patterns
  (i) co-polarization - difference pattern
  (ii) cross-polarization - null pattern
(b) cross-polar plane patterns
  (i) co-polarization - null pattern
  (ii) cross-polarization - difference pattern.

Thus, there has been described log-periodic slot antennas having the following features:

(1) Off-center feeds of the slot elements to obtain the required phase reversals and low input impedances.

(2) The provision of a small ground plane to get the difference pattern from a single log-periodic slot antenna. The difference pattern is one the co-polar plane (i.e., the plane perpendicular to the ground plane) with co-polarization (i.e., E vector perpendicular to the ground plane - the regular polarization of a slot antenna). There is also a sum pattern on the cross-polar plane with cross-polarization.

(3) The dual log-periodic slot antenna exhibiting two difference patterns. One difference pattern is on the co-polar plane with co-polarization and other is on the cross-polar plane cross-polarization. Such a dual log-periodic slot antenna always has a null in the axial direction for any polarization. Therefore with a spinning dual log-periodic slot antenna in the axial direction, a transmitter direction can always be located. The change in polarization, and imperfections in antenna construction, do not affect the location of the null.

I claim:

1. A log periodic slot antenna comprising an array of spaced, parallel radiating slots of increasing length, said parallel, radiating slots having a common center line in the direction running perpendicular to parallel planes of the slots, a plurality of coplanar guides, each guide connecting one pair of adjacent slots along the antenna array, the coplanar guides being arranged alternately on opposite sides of the common center line of the antenna, each pair of adjacent slots being connected by said guide at a distance approximately one quarter of the slots' lengths from the respective ends of the slots and a feed connection to a radiating slot at one end of the antenna, the connection being at the side of the slot opposite to its coplanar guide connection and at a distance from the respective end of the slot approximately one quarter of the slot length.

2. An antenna as defined in claim 1, further comprising a longitudinally extending, elongate, narrow slot adjacent said feed connection to perform the function of a low frequency block.

3. A log periodic slot antenna having an array of spaced, parallel, radiating slots, said slots having a common center line in the direction running perpendicular to parallel planes of the slots;

a set of coplanar guides extending generally longitudinally of the antenna, each guide connecting one pair of adjacent slots along the antenna array;

a feed connection to a radiating slot at one end of the antenna, the connection being at the side of the slot opposite to its coplanar guide connection and at a distance from the respective end of the slot equal to one quarter of the slot length;

the coplanar guides being arranged alternately on opposite sides of the common center line of the antenna, each pair of adjacent slots being connected by said guide at a distance approximately one quarter of the slots' lengths from the respective ends of the slots.

4. An antenna as defined in claim 3, further comprising a longitudinally extending, elongate, narrow slot adjacent said feed connection to perform the function of a low frequency block.

5. A log periodic slot antenna comprising a ground plane conductor having an array of spaced, parallel radiating slots of increasing length, said parallel, radiating slots having a common center line in the direction running perpendicular to parallel planes of the slots, a plurality of coplanar guides, each guide connecting one pair of adjacent slots along the antenna array, the coplanar guides being arranged alternately on opposite sides of the common center line of the antenna, each pair of adjacent slots being connected by said guide at a distance approximately one quarter of the slots' lengths from the respective ends of the slots, and a feed connection to a radiating slot at one end of the antenna, the connection being at the side of the slot opposite to its coplanar guide connection and at a distance from the respective end of the slot approximately one quarter of the slot length, the dimension of the ground plane being of the same order of magnitude as the dimensions of the array whereby the antenna pattern has a null in the forward direction in the plane of the ground plane.

6. An antenna as defined in claim 5 further comprising a longitudinally extending, elongate, narrow slot adjacent said feed connection to perform the function of a low frequency block.

7. A direction finding antenna comprising a pair of log periodic slot antennas each as defined in claim 5, said antennas being arranged with a common vertex and with their ground planes co-planar, an in-phase feed connection for each antenna whereby the cross-polarization antenna pattern in the plane of the antenna has a null in the forward direction.

8. A log periodic slot antenna comprising a ground plane conductor having an array of spaced, parallel, radiating slots, said parallel, radiating slots having a common center line in the direction running perpendicular to parallel planes of the slots;

a set of coplanar guides extending generally longitudinally of the antenna, each guide connecting one pair of adjacent slots;

a feed connection to a radiating slot at one end of the antenna, the connection being at the side of the slot opposite to its coplanar guide connection and at a distance from the respective end of the slot equal to one quarter of the slot length;

the coplanar guides being arranged alternately on opposite sides of the common center line of the antenna, each pair of adjacent slots being connected by said guide at a distance approximately one quarter of the slots' lengths from the respective ends of the slots.

9. An antenna as defined in claim 8 further comprising a longitudinally extending, elongate, narrow slot adjacent said feed connection to perform the function of a low frequency block.

10. A direction finding antenna comprising a pair of log periodic slot antennas each as defined in claim 8, said antennas being arranged with a common vertex and with their ground planes co-planar, an in-phase feed connection for each antenna whereby the cross-polarization antenna pattern in the plane of the antenna has a null in the forward direction.

11. A direction finding antenna as defined in claim 10 wherein the in-phase feed connection comprises a pair of co-planar guides, one for each antenna, extending adjacent to the vertex and coupled to a feed connector at that point.

* * * * *

UNITED STATES PATENT AND TRADEMARK OFFICE

CERTIFICATE OF CORRECTION

PATENT NO. : 4,922,262

DATED : May 1, 1990

INVENTOR(S) : YUNG LEONARD CHOW

It is certified that error appears in the above-identified patent and that said Letters Patent is hereby corrected as shown below:

Column 1, line 33, equation "$Z_5 = \frac{(377)^2}{42d} \Omega$"

should read -- $Z_s = \frac{(377)^2}{4\ Z_d} \Omega$ --;

lines 35-36, delete "logberiodic" and insert --log-periodic--;

line 58, " /4" should read -- $\ell/4$--;

line 62, " /4" should read -- $\ell/4$--;

line 63, " /2" should read -- $\ell/2$--;

line 67, " /4" should read -- $\ell/4$--;

line 68, " /4" should read -- $\ell/4$--;

Signed and Sealed this

Ninth Day of July, 1991

*Attest:*

HARRY F. MANBECK, JR.

*Attesting Officer*

*Commissioner of Patents and Trademarks*